US009757843B2

(12) United States Patent
Edge

(10) Patent No.: US 9,757,843 B2
(45) Date of Patent: Sep. 12, 2017

(54) BAR CLAMP ACCESSORIES

(71) Applicant: William Henry Edge, Deer Park, WA (US)

(72) Inventor: William Henry Edge, Deer Park, WA (US)

( * ) Notice: Subject to any disclaimer, the term of this patent is extended or adjusted under 35 U.S.C. 154(b) by 0 days.

(21) Appl. No.: 14/801,031

(22) Filed: Jul. 16, 2015

(65) Prior Publication Data

US 2017/0014975 A1 Jan. 19, 2017

(51) Int. Cl.

| | |
|---|---|
| ***B25B 5/16*** | (2006.01) |
| ***B25B 5/02*** | (2006.01) |
| ***B25B 5/00*** | (2006.01) |
| ***B25B 5/14*** | (2006.01) |
| ***B25B 5/08*** | (2006.01) |
| ***B25B 1/10*** | (2006.01) |
| ***B25B 1/24*** | (2006.01) |
| ***B25B 1/22*** | (2006.01) |

(52) U.S. Cl.

CPC ..... *B25B 5/163* (2013.01); *B25B 1/2457* (2013.01); *B25B 5/003* (2013.01); *B25B 5/006* (2013.01); *B25B 5/02* (2013.01); *B25B 5/085* (2013.01); *B25B 5/14* (2013.01); *B25B 1/103* (2013.01); *B25B 1/22* (2013.01)

(58) Field of Classification Search

CPC ..... B25B 1/20; B25B 1/2452; B25B 1/205; B25B 5/003; B25B 5/006; B25B 5/163; B25B 5/02; B25B 5/102; B25B 5/166; B25B 5/068

See application file for complete search history.

(56) References Cited

U.S. PATENT DOCUMENTS

| | | | | |
|---|---|---|---|---|
| 2,244,219 | A | 6/1941 | Sampson | |
| 2,669,958 | A * | 2/1954 | Sweeney | B23K 37/0426 269/45 |
| 3,909,889 | A | 10/1975 | Emerson | |
| 4,583,724 | A * | 4/1986 | Huang | B25B 1/20 269/182 |
| 4,834,352 | A * | 5/1989 | Thornton | B25B 5/06 269/203 |
| D366,819 | S | 2/1996 | Wooster, Jr. et al. | |
| 6,050,559 | A | 4/2000 | de Souza | |
| 6,089,556 | A | 7/2000 | Whiteford | |
| 6,530,565 | B1 | 3/2003 | Simpson | |
| 7,322,571 | B2 | 1/2008 | Springer | |
| 2003/0111172 | A1 | 6/2003 | Devers | |
| 2011/0079946 | A1 * | 4/2011 | Yang | B25B 5/003 269/88 |

OTHER PUBLICATIONS

"1¼ in. 90-Degree Corner Clamp", The Home Depot, retrieved on May 8, 2015 at <<http://www.homedepot.com/p/Kreg-1-1-4-in-90-Degree-Corner-Clamp-KHC-90DCC/205435696?keyword+1-1%2F4+in.+90+degree+corner+clamp>>, 2 pages.

(Continued)

*Primary Examiner* — Monica Carter
*Assistant Examiner* — Seahee Yoon

(57) ABSTRACT

This disclosure generally pertains to various accessories for use with bar clamps to enhance the capabilities and functionality of the bar clamps. The accessories described in detail herein include removable and replaceable bar clamp attachments, bar extenders, and stability stands for use with a bar clamp.

6 Claims, 13 Drawing Sheets

(56) References Cited

OTHER PUBLICATIONS

"60 inch Universal Bar Clamp", Woodcraft, retrieved on May 8, 2015 at <<http://www.woodcraft.com/Product/818189/60-Universal-Bar-Clamp.aspx>>, 2 pages.
"Clamps", Rockler Woodworking and Hardware, retrieved on May 8, 2015 at <<http://www.rockler.com/clamps>>, 6 pages.
"Special Application Clamps", Rockler Woodworking and Hardware, retrieved on May 8, 2015 at <<http://www.rockler.com/clamps/special-application-clamps>>, 5 pages.
"stalwart-tabletop-vice-360-degree-swivel", Overstock.com, retrieved on May 8, 2015 at <<http://www.overstock.com/search?keywords=stalwart-tabletop-vice-360-degree-swivel&SearchType=Header>>, 3 pages.

* cited by examiner

BAR CLAMP ACCESSORIES

BACKGROUND

Bar clamps are well known to craftsmen and hobbyists for use in holding objects in a fixed position. Bar clamps can be used to hold two or more objects together in a fixed position for gluing, soldering, or welding, among other things. When needed, a craftsman or hobbyist places the bar clamp around the one or more objects, and adjusts the clamp to press the objects together. A woodworker who desires to secure a piece of wood while cutting it with a table saw, for example, can secure one or more clamps around the piece of wood and a guide, thereby fixing the piece of wood to the guide for accurate cutting.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIG. 11A depicts a bar clamp with one adjustable attachment and one fixed attachment. FIG. 11B depicts a bar clamp with two adjustable bar clamp attachments, in accordance with some examples of the present disclosure.

FIG. 12A depicts an embodiment with a rotating contact point with a semi-cylindrical profile. FIG. 12B depicts an embodiment with a single contact point. FIG. 12C depicts an embodiment of an attachment with a rotating face comprising three contact points, in accordance with some examples of the present disclosure.

DETAILED DESCRIPTION

Figure 1:
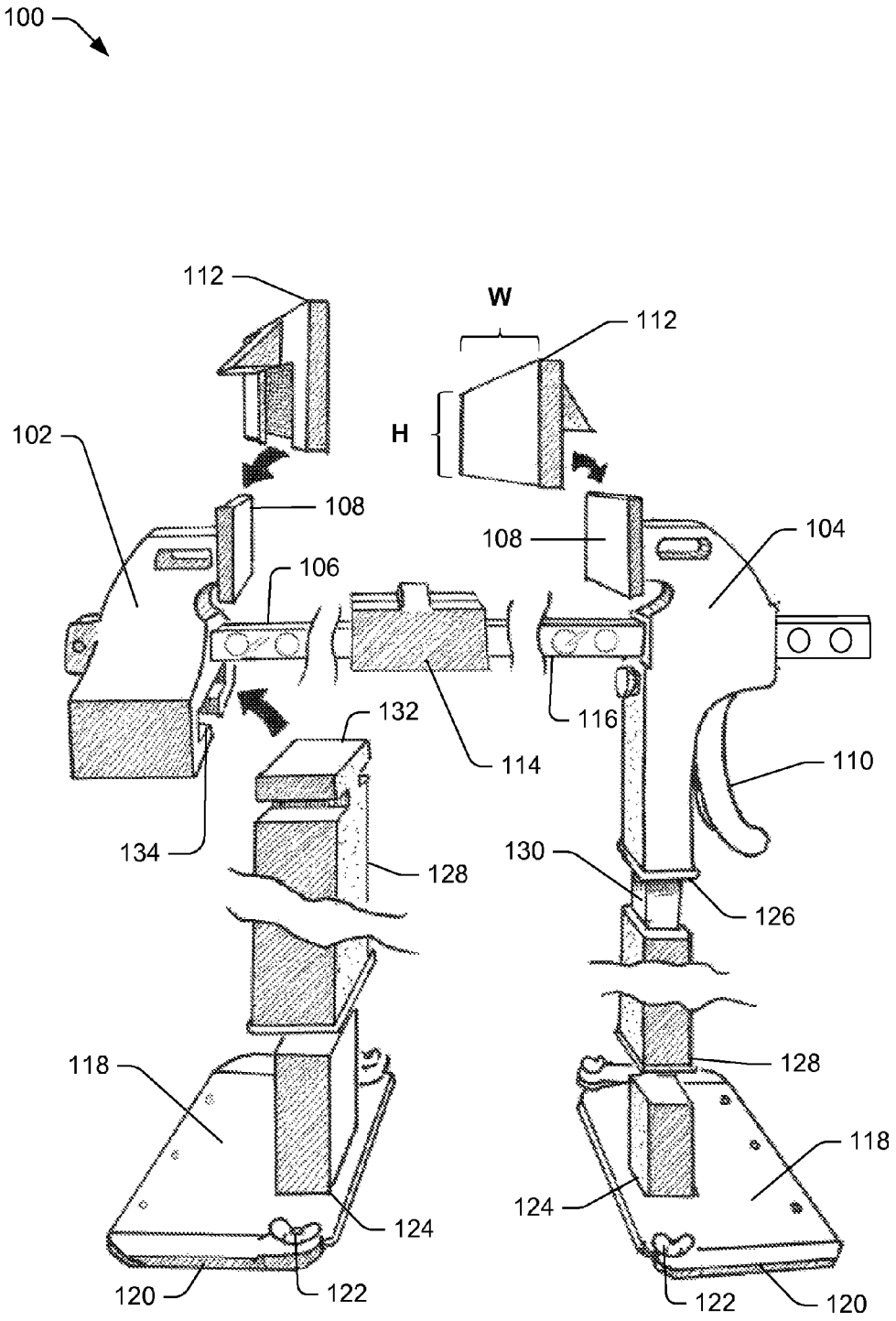
FIG. 1 is an isometric view of an illustrative bar clamp assembly with attachments, a bar extender, and stability stands attached thereto, in accordance with some examples of the present disclosure.

Traditionally, bar clamps are limited to use with surfaces that are relatively flat, uniform, and meet certain size constraints. This disclosure generally pertains to various accessories for use with bar clamps to enhance the capabilities and functionality of the bar clamps. The accessories described in detail herein include bar clamp attachments, bar extenders, and stability stands for use with a bar clamp.

The clamp attachments described herein can securely attach to a base clamping surface, and can provide improved functionality for, and use of, the bar clamp. In some embodiments, the clamp attachments can extend the height of a clamping surface (e.g., perpendicular from the bar). In such embodiments, one or more contact points on the clamp attachments can enable the bar clamps to be secured to surfaces and/or objects of uniform and/or non-uniform distribution such as, for example, around a lip of a table.

In some embodiments, the clamp attachments can be adjustable and/or interchangeable to provide multiple configurations. The clamp attachment can include one or more contact points (e.g., pointed surfaces, flat surfaces, rounded surfaces, etc.), for example, capable of extension and retraction. In such an example, the contact points of the clamp attachments can be capable of securing both regular and irregular objects (e.g., objects of non-uniform distribution). In other examples, the clamp attachment can include one or more contact points that are movable about one or more axes (e.g., the contact points can pivot, swivel, hinge, spin, etc.). In this manner, a hobbyist painting an object fixed between two or more contact points, for example, can be able to spin the object secured between the contact points. This can enable the user to paint 360 degrees around an object, for example, without having to remove the object from the clamp to move it into a different orientation.

The accessories can also include a bar extender. In some embodiments, the bar extender can adjust the working, or clamping, length of the bar. In such embodiments, the bar clamp can be capable of securing increasingly wider objects. In some embodiments, the bar extender can include two or more bar extenders connected in a multi-dimensional configuration, thereby creating a multi-dimensional bar clamp. In other embodiments, the multi-dimensional bar clamp can comprise one base extender configured to connect multiple bars of bar clamps.

Additionally the accessories can also include a stand. The stand can include a stable surface to hold the bar clamp in an upright position. In some examples, the stand can also include extendable implements to enlarge the footprint of the stand, further increasing stability (e.g., lateral and/or longitudinal stability).

The bar clamp accessories described herein can be detachable and replaceable, and thus capable of multiple uses. The bar clamp assemblies comprising one or more accessories can be reconfigurable for objects of various sizes and/or shapes, including those that could not previously be secured with a bar clamp. As such, a single bar clamp assembly with interchangeable attachments can replace multiple specialized clamps.

Example Bar Clamp Accessories

FIG. 1 is an isometric view of an illustrative bar clamp assembly 100 with attachments, bar extenders, and stability stands attached thereto. Components of the bar clamp assembly 100 can comprise wood, metal (e.g., aluminum, steel, stainless steel, titanium, alloys thereof, etc.), plastic (e.g., high-density polyethylene, acrylic, melamine, polycarbonate, etc.), composite (e.g., fiberglass, carbon fiber, etc.), and/or combinations thereof, among others.

The bar clamp assembly 100 depicted in FIG. 1 can include a fixed jaw 102, a movable jaw 104, and a bar 106 connecting the fixed jaw 102 and the movable jaw 104. In various embodiments, the fixed jaw 102 can be fixed to a first end of the bar 106. In some embodiments, the fixed jaw 102 can be fixed proximate to a first end of the bar 106.

The movable jaw 104 of the bar clamp assembly 100 can be movable along the bar 106 in a linear manner between a first position proximate to the fixed jaw to a second position proximate to a second end of the bar 106. The position of the movable jaw 104 can be adjusted in order to secure an object between two or more clamping surfaces 108. In various embodiments, the movable jaw 104 can include a trigger release 110 to adjust the position of the movable jaw 104 along the bar 106. In some embodiments, the movable jaw 104 can be adjusted with other mechanical release mechanisms (e.g., a push button, switch, knob, and the like).

In various embodiments, a base plate 112 can be configured to attach to the clamping surfaces 108 on the fixed jaw 102 and/or the movable jaw 104. In some embodiments, the base plate 112 can include a clamping surface of various shapes (e.g., a flat surface, a semi-circular surface, a semi-cylindrical surface, a pointed dowel, a rounded dowel, a pin, etc.) and/or configurations (e.g., a stationary, rotating, rubber surface, a plastic surface, a knurled surface, and combinations thereof). In some embodiments, the base plate 112 can extend a height H and/or width W outside the clamping surface 108. In some embodiments, the base plate 112 can be configured with one or more attachments fixed to the base plate 112 detachably coupled to the base plate 112, or integrally formed into the base plate 112.

Additionally, the bar 106 of the bar clamp assembly 100 can be extendable via a bar extender 114. The bar extender 114 can enable the bar 106 to be attached to a replaceable bar 116, thereby increasing the overall length of the bar clamp assembly 100. In some embodiments, two or more bar extenders 114 and replaceable bars 116 can be combined to increase the clamping capabilities of the bar clamp 100. In some embodiments, the bar clamp assembly 100 can be capable of clamping in more than one dimension. The bar extender 114 is explained in greater detail below in the discussion of FIGS. 8 and 9.

As shown in FIG. 1, the movable jaw 104 and/or fixed jaw 102 can be configured to connect to a stand 118. The stand 118 can comprise wood, metal, plastic, composite, and combinations of the foregoing, among others.

In various embodiments, the stand 118 can include one or more foot extenders 120 to further increase the footprint of the stand 118. In such embodiments, the one or more foot extenders 120 can be adjustable. In some examples, the one or more foot extenders 120 can be pivoted outward from the stand 118 by adjusting a securing mechanism 122 (e.g., a nut, a push button, etc.).

In other embodiments, the one or more foot extenders 120 can extend and retract in a linear manner from the stand 118, such that the one or more foot extenders 120 extend parallel to the side of the stand 118. In such embodiments, the one or more foot extenders 120 can be connected to the stand 118 via a tongue and grove joint, for example, or by one or more rods housed in the stand 118. Thus, when a pulling force is applied to the foot extender 120, for example, the foot extender 120 can be pulled away from the stand 118 along a path defined by the rod tracking in a housing within the stand 118.

The stand 118 can also include a vertical support 124. The vertical support 124 can extend vertically from a base of the stand 118. In some embodiments, the vertical support 124 can seat in a housing, such as a housing 126 of the movable jaw 104. In this configuration, the fixed jaw 102 can include housing 126, into which the vertical support 124 seats. In various embodiments, the vertical support 124 can include a rubber coating, a plastic coating, or any other material and/or machining process (e.g., knurling) that may increase friction to more firmly secure the vertical support 124 into the housing 126.

In some embodiments, the vertical support 124 of the stability stand 118 can securely attach to the stand extender 128. As shown, the stand extender 128 can comprise a sleeve over the vertical support 124. In this manner, the stand extender 128 can be a universal extender for any stand 118 with a vertical support 124.

In various embodiments, the stand extender 128 can also include a stet 130. In some embodiments, the stet 130 can be adjustable in a vertical direction, effectively increasing the height of the vertical support 124 of the stability stand 118. In some embodiments, the stet 130 can include a rubber coating, a plastic coating or any other material and/or machining process (e.g., knurling) that may increase friction to more firmly secure the stet 130 into the housing 126. In some embodiments, the stet 130 can be secured in the housing 126 via an internal clamping mechanism. In such embodiments, the internal clamping mechanism can be secured and released via a push button mechanism, set screw, clip, pin, or other locking mechanism located on the stet 130 or in the housing 126. The stet 130 can include, for example, a rack and pinion, hydraulic piston, and/or other structures to provide securable, vertical movement.

In some embodiments, the stand extender 128 can include a connector 132. The connector 132 can include a rubber coating, a plastic coating or any other material and/or machining process (e.g., knurling) that may increase friction to more firmly secure the connector 132 into a housing 134 with a complementary connector. In some embodiments, the housing 134 and/or connector 132 can also include a locking mechanism (e.g., a detent, set screw, push button, etc.) to secure the connector 132 into the housing 134. As shown in FIG. 1, the connector 132 and housing 134 can comprise a T-shaped design. In other examples, however, the connector 132 and housing 134 may include other complementary shapes, such as, for example, a semi-circular shape, a circular shape, a square shape, etc.

Figure 2:
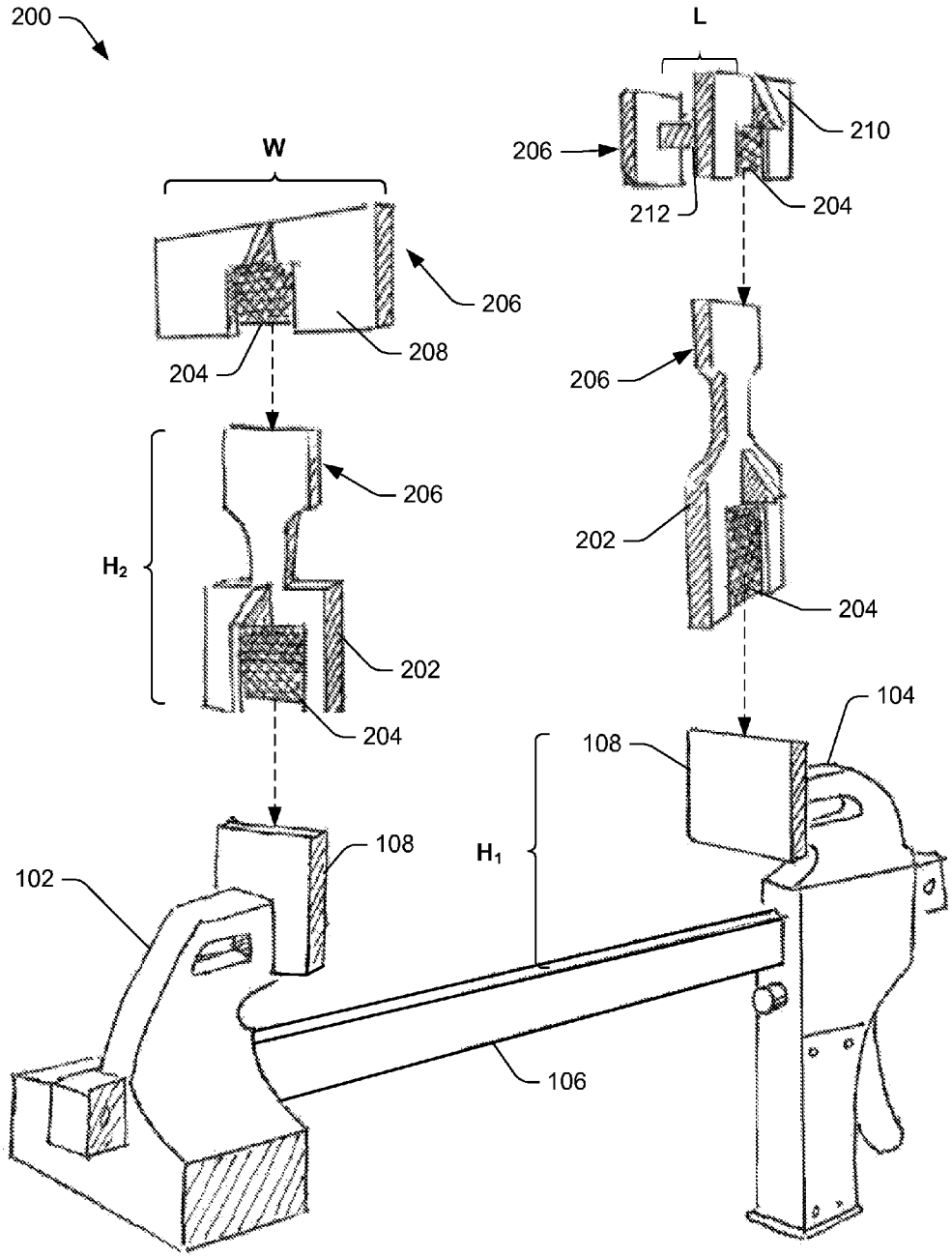
FIG. 2 is a perspective view of various example attachments for use with a bar clamp to increase the capability of the bar clamp by increasing a clamping surface area, in accordance with some examples of the present disclosure.

FIG. 2 is an isometric view of an example bar clamp assembly 200 with various attachments configured to increase the capability of the bar clamp by increasing a clamping surface depth and/or area. Bar clamp assembly 200, similar to bar clamp assembly 100, can include a fixed jaw 102, a movable jaw 104, a bar 106, and two clamping surfaces 108.

In various embodiments, clamping surfaces 108 can be configured to include one or more removable and/or replaceable attachments, such as extension attachments 202. Various attachments can be removable and replaceable via one or more fittings 204. For a first clamping job, for example, it may be desirable to have an attachment with a large clamping surface. While, for a second clamping job, it can be desirable to remove the attachment with the large clamping surface and replace it with an attachment having a smaller clamping surface.

The various attachments may be removable and/or replaceable via a fitting 204. In some embodiments, the fitting 204 can comprise a sleeve configured on a bottom end of the extension attachment 202. The sleeve may be configured to house a clamping surface 108 and/or a base plate 112 (FIG. 1). In some embodiments, the fitting 204 can comprise a cutout configured to couple to the clamping surface 108 and/or the base plate 112 (FIG. 1).

In various embodiments, the fitting 204 can include a rubber coating, a plastic coating, or any other material and/or machining process (e.g., knurling) that may increase friction to more firmly secure the attachments to the clamping surface 108 and/or the base plate 112 (FIG. 1). Additionally or alternatively, the fitting 204 can comprise one or more magnets to firmly secure the various attachments in place against a clamping surface of a bar clamp.

In various embodiments, the fitting 204 can comprise a locking mechanism (e.g., a detent, a set screw, push button, etc.) to more firmly secure the attachments to the clamping surface 108 and/or the base plate 112 (FIG. 1).

In the illustrative example, the attachments that connect to the clamping surface 108 can be extension attachments 202. The extension attachments 202 can extend the clamping surface height (e.g., the distance from the bar 106 to the top of the extension attachment 202) of the bar clamp assembly 200. As illustrated in FIG. 2, the clamping surface height can be increased to a distance H from the original height $H_1$ clamping surface 108. One skilled in the art understands that some height may be lost to the interface between extension attachments 202 and clamping surface 108.

In some embodiments, the extension of the clamping surface height can provide uniform clamping pressure along the extended height $H_2$ of the extension attachments 202. In other embodiments, the clamping pressure may be limited to discrete contact points 206. In the illustrative embodiment, the contact points 206 include a substantially flat surface for clamping objects. In other embodiments, the contact points 206 can include, for example, pointed surfaces, rounded surfaces, sloped surfaces, pointed dowels, rounded dowels, and/or one or more pins. In various embodiments, the contact points 206 can also be adjustable about one or more axes.

In various embodiments, the extension attachments 202 can be configured to connect to additional attachments, such as a width extension 208 and/or a depth extension 210. In such embodiments, the fittings 204 on the width extension 208 and the depth extension 210 can interface with a portion of the extension attachment 202. In such embodiments, the bar clamp assembly 200 can be capable of clamping surfaces with irregular shapes such as, for example, a table with a lip, as illustrated in FIG. 3.

In various embodiments the width extension 208 can extend the width of contact point 206. In such embodiments, the clamping pressure applied to an object by the bar clamp assembly 200 with the width extension 208 attached may be of a greater area than a bar clamp assembly with a standard clamping surface, such as, for example, clamping surface 108.

In various embodiments, the depth extension 210 can include a fitting 204, a contact point 206, and a horizontal extender 212. In other embodiments, the horizontal extender 212 can be a fixed length L. In some embodiments, the horizontal extender 212 can be adjustable and comprise, for example, a telescopic arm.

Figure 3:
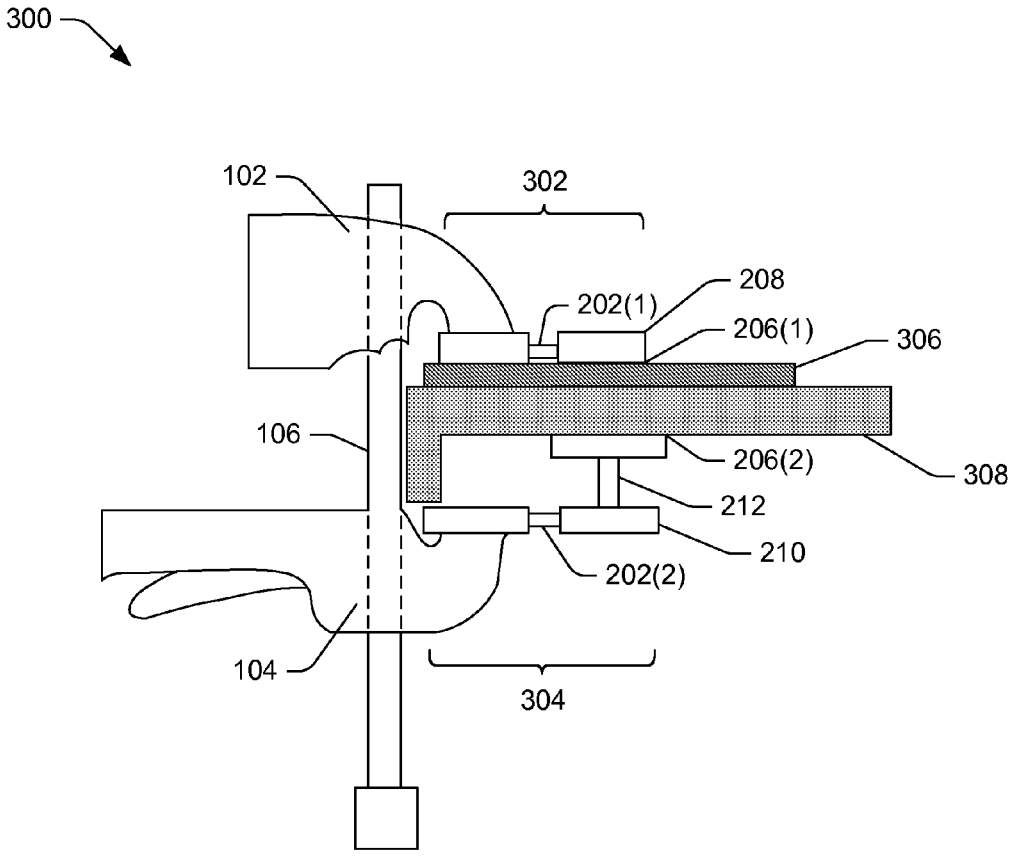
FIG. 3 is a side view of a bar clamp assembly with the example attachments shown in FIG. 2 connected together to increase the area of the clamping surface in accordance with some examples of the present disclosure.

FIG. 3 is a side view of a bar clamp assembly 300 with the attachments shown in FIG. 2 connected together to increase the height (e.g., distance from the bar) and depth of the clamp. The bar clamp assembly 300 includes a fixed jaw 102, a movable jaw 104, and a bar 106. In the illustrative example, a first attachment assembly 302 and a second attachment assembly 304 include opposite clamping surfaces to clamp a first surface of an object 306 and a second surface of an object 308 together. The first object could be a table with a lip, for example and the second object could be a piece of decorative wood or laminate to form the table top.

The first attachment assembly 302 can connect to the fixed jaw 102 via a clamping surface, such as the clamping surface 108. In some embodiments, the first attachment assembly can include an extension attachment 202(1) and a width extender 208. The first attachment assembly 302 can provide a relatively uniform distribution of clamping pressure on the first surface 306 via contact point 206(1).

In some embodiments, the second attachment assembly 304 can include an extension attachment 202(2) and a depth extender 210. The second attachment assembly 304 can provide a relatively uniform distribution of clamping pressure on a second surface 308 via contact point 206(2).

As illustrated in FIG. 3, the extension attachments 202 extend the distance between the contact point 206 and the bar 106 and/or the distance between the contact point 206 and the clamping surface 108. The increased distance can provide the bar clamp assembly 300 with the ability to clamp larger and/or non-uniform surfaces together. A standard bar clamp may not be capable of clamping objects around a lip of a table, for example. As shown in FIG. 3, however, the extension attachments 202 and the depth extender 210 make it possible to clamp an object to the table with a lip. It is understood that a table with a lip is but one example, and many other non-uniform surfaces and/or objects are imagined. In examples where the bar 106 is positioned vertically or at an angle from a horizontal position, the bar clamp assembly can omit the stability stand 118, or use a stand with a different configuration.

Figure 4:
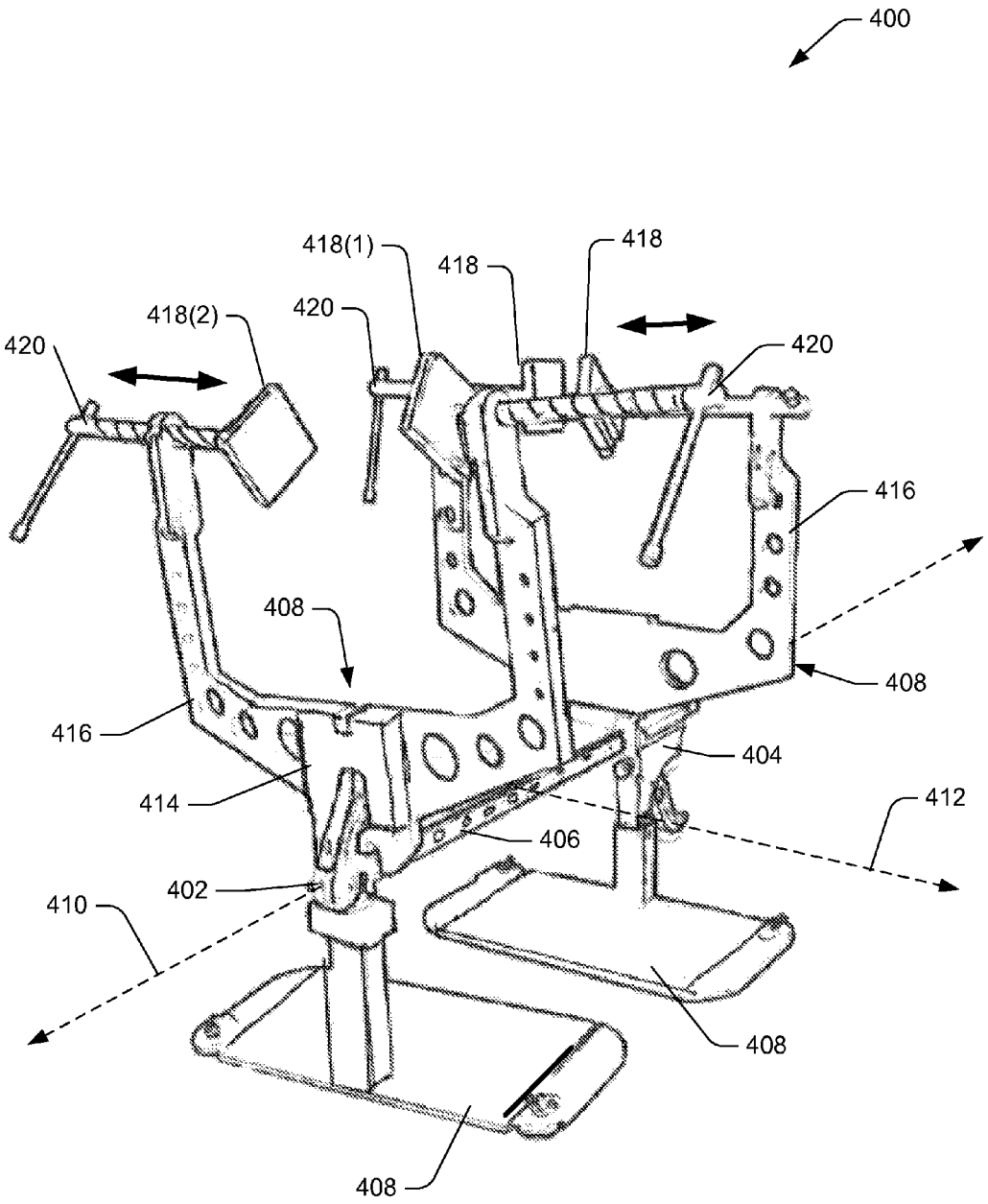
FIG. 4 is a perspective view of an example bar clamp assembly with clamping attachments and stability stands attached thereto, in accordance with some examples of the present disclosure.

FIG. 4 is a perspective view of a bar clamp with clamping attachments configured to clamp an object as multiple points. Bar clamp assembly 400 can include a fixed jaw 402, similar to fixed jaw 102, a movable jaw 404, similar to movable jaw 104, a bar 406, similar to bar 106, stability stands 408, similar to stability stands 118, and attachments 408.

As illustrated in FIG. 4, the bar clamp assembly 400 can include a longitudinal axis 410 and a lateral axis 412. In the illustrative example, the longitudinal axis 410 is aligned with the bar 406 and the lateral axis 412 is aligned perpendicular to the longitudinal axis 410.

In various embodiments, the bar clamp assembly 400 can include attachments 408 for clamping objects by applying pressure along the lateral axis 412, the longitudinal axis 410, or combinations thereof. The attachments 408 can include a fitting 414, a frame 416, two or more contact points 418, and two or more adjusters 420. In various embodiments, the fittings 414 can be configured to couple the attachment 408 to a clamping surface of the bar clamp assembly 400, such as clamping surface 108. The fitting may comprise a sleeve, a cutout, or any other mechanism for coupling to the clamping surface. In some embodiments, an inside surface of the fittings 414 can include a rubber coating, a plastic coating, or any other material and/or machining process that may increase friction to more firmly secure the attachments 408 to the fixed jaw 402 and the movable jaw 404. Additionally or alternatively, the fitting 204 can comprise one or more magnets to firmly secure the attachments 408 to the fixed jaw 402 and the movable jaw 404.

In some embodiments, the attachments 408 can include a frame 416. In such embodiments, the frame 416 can increase the clamping capacity of the bar clamp assembly 400 (e.g., the contact points 418 and thus, a clamped object, may be displaced from the bar 406 an additional distance). In the illustrative embodiment, the frames 416 are U-shaped. In other embodiments, the stands can include, for example, a V-shape, a semi-circular shape, a rectangular shape, or many other shapes.

Attachments 408 can include one or more contact points 418. As shown, the contact points 418 can be square shaped. The contact points 418 can also be circular, rectangular, a pin, a rounded pin, or other contact surfaces capable of securely holding an object in a clamp.

In various embodiments, the contact points 418 can be adjustable, sand can include adjusters 420. In FIG. 4, each of the contact points 418 are shown as adjustable along the lateral axis 412. In other embodiments, however, one contact point 418(1) can be adjustable, while the other contact point 418(2) can be fixed, or vice versa.

In various embodiments, the one or more contact points 418 can be capable of pivoting about a point and/or rotating about an axis. The one or more contact points 418 can be configured to pivot about a joint connecting the contact point 418 and the adjuster 420. For example, the contact point 418 can connect to the adjuster via a ball and socket joint. This configuration can enable the contact point 418 to swivel within a predetermined range of motion and rotate through 360 degrees.

In the illustrative embodiment, the adjusters 420 include a screw-type adjusting mechanism. In other embodiments, the adjusters 420 can include a pin, a band, snap ring, or other types of threaded or non-threaded fasteners to secure the contact point 418 in a fixed position.

Figure 5:
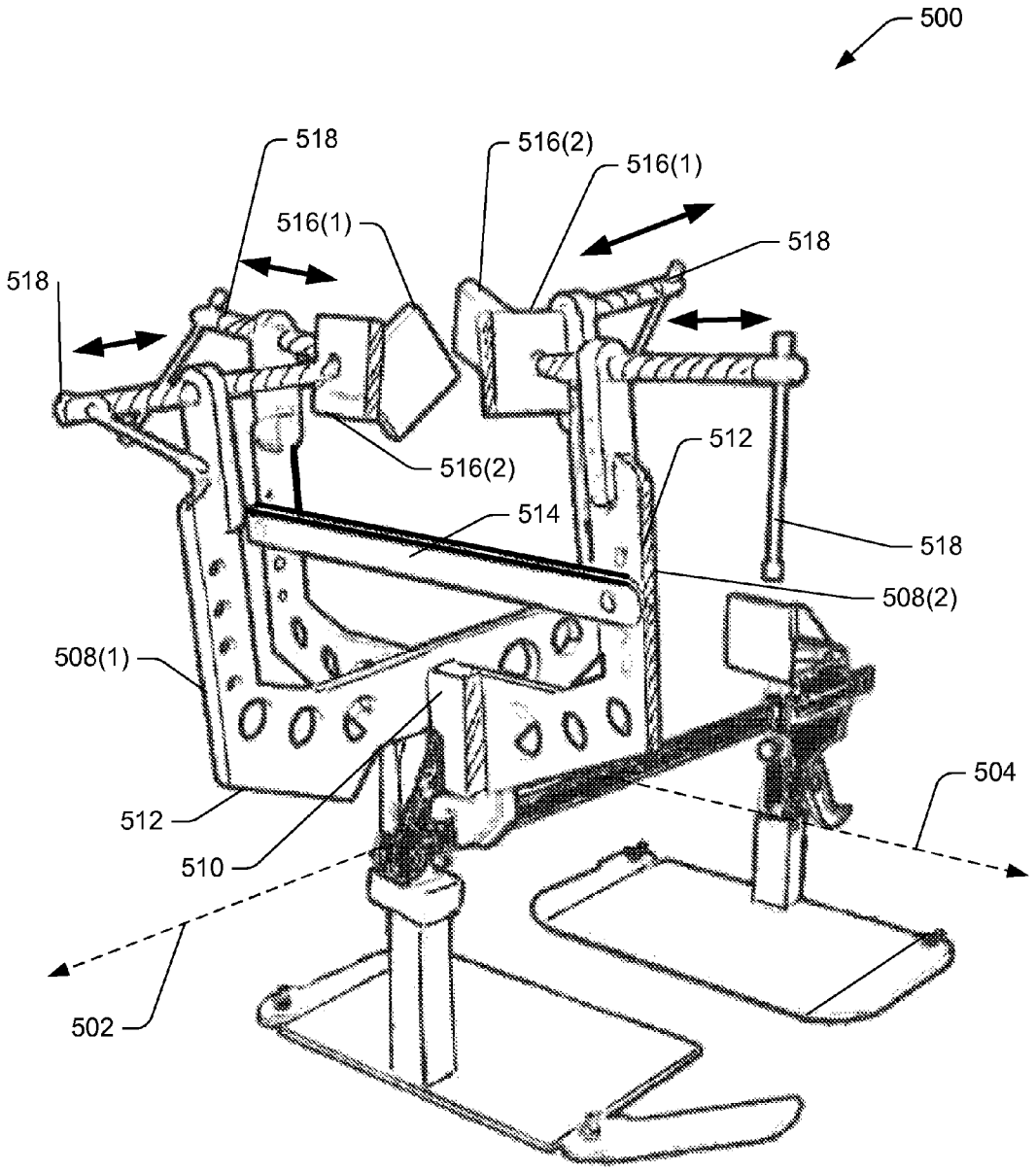
FIG. 5 is a perspective view of an example bar clamp assembly with X-Y axis clamping attachments and stability stands attached thereto, in accordance with some examples of the present disclosure.

FIG. 5 depicts an embodiment of a bar clamp assembly with lateral and longitudinal clamping attachments. Bar clamp assembly 500 can include a fixed jaw, a movable jaw, a bar, stability stands, and/or any of the components described above with regard to FIGS. 1-4. For simplicity, the discussion with regard to FIG. 5 will focus on the lateral and longitudinal clamping attachments.

As illustrated in FIG. 5, the bar clamp assembly can include a longitudinal axis 502, and a lateral 504, such as longitudinal axis 410 and lateral 412.

In various embodiments, bar clamp assembly 500 can include attachment 508(1) and attachment 508(2) for clamping objects along the longitudinal axis 502, the lateral axis 504, or combinations thereof. Attachments 508(1) and 508(2) can include one or more of a fitting 510, a frame 512, a support beam 514, two or more contact points 516, and two or more adjusters 518. As shown in FIG. 5, attachment 508(1) includes a fitting 510, two arms 512, a support beam 514, two contact points 516, and two adjusters 518, whereas attachment 508(2) includes two arms 512, two contact points 516, and two adjusters 518.

In various embodiments, the fitting 510 can be configured to couple the attachment 508(1) to a clamping surface of a bar clamp assembly 500. The fitting can be comprised of a sleeve, a cutout, one or more magnets, or other surface capable of coupling to a clamping surface. In some embodiments, an inside surface of the fitting 510 can include a rubber coating, a plastic coating, or any other material and/or machining process that may increase friction to more firmly secure the attachment 508(1) in place on a bar clamp (e.g., to clamping surfaces of the respective jaws). In the illustrative embodiment, the attachment 508 is coupled to the clamping surface proximate and/or coupled to the fixed jaw of the bar clamp assembly 500. Additionally or alternatively, the attachment 508 can couple to the clamping surface proximate and or coupled to the movable jaw of the bar clamp assembly 500.

In various embodiments, the attachments 508(1) and 508(2) can include two or more arms 512. The two or more arms 512 can increase the clamping capacity of the bar clamp assembly 500. As shown in FIG. 5, the two or more arms 512 can cooperate to form a U-shape. In other embodiments, however, the two or more arms can include a V-shape, a semi-circular shape, a rectangular shape, or other shapes.

In some embodiments, the two or more arms 512 can include a support beam 514. In such embodiments, the support beam 514 can include a bar that extends from one arm of the frame to the other. The support beam 514 can be configured to provide lateral support while an object is clamped between two or more contact points in the bar clamp assembly 500 (e.g., the support beam can prevent the stand from bending or moving when a clamping force is applied to the clamping surfaces 516). As shown, the bar clamp assembly 500 includes a support beam aligned with the lateral axis. Additionally or alternatively, the bar clamp assembly 500 can include a support beam aligned with the longitudinal axis.

In various embodiments, the attachments 508(1) and 508(2) can include two or more contact points 516. As shown in FIG. 5, the four contact points 516 are square shaped. However, one or more of the contact points can be circular, semi-circular (as depicted in FIG. 14A), rectangular, pin points (as depicted in FIGS. 14B and 14C), rounded points, or many other shapes and/or surfaces capable of securely holding an object in a clamp. For example, one contact point may comprise a semi-circular shape, while the opposing contact point may comprise a square shape.

In some embodiments, the contact points 516 can be adjustable along a respective axis, such as via adjusters 518. In the illustrative embodiment, the contact points 516(1) are adjustable along the lateral axis, and the contact points 516(2) are adjustable along the longitudinal axis, via adjusters 518. In some embodiments, one of contact points 516(1) and/or 516(2) can be adjustable along the respective axis, while the opposite contact point 516(1) or 516(2) can be non-adjustable.

As illustrated in FIG. 5, the adjusters 518 can comprise a screw-type adjusting mechanism. In some embodiments, the adjusters 518 can comprise a pin, a band, snap ring, or other type of threaded or non-threaded fastener to secure the contact point 516 in a desired position.

In various embodiments, the contact points 516 can be configured to pivot or rotate about an axis. The contact points 516 can pivot and/or swivel about a joint connecting the contact point 516 and the adjuster 518. For example, the contact point 518 can connect to the adjuster via a ball and socket joint. This configuration can enable the contact point 418 to swivel within a predetermined range of motion and rotate through 360 degrees.

Figure 6:
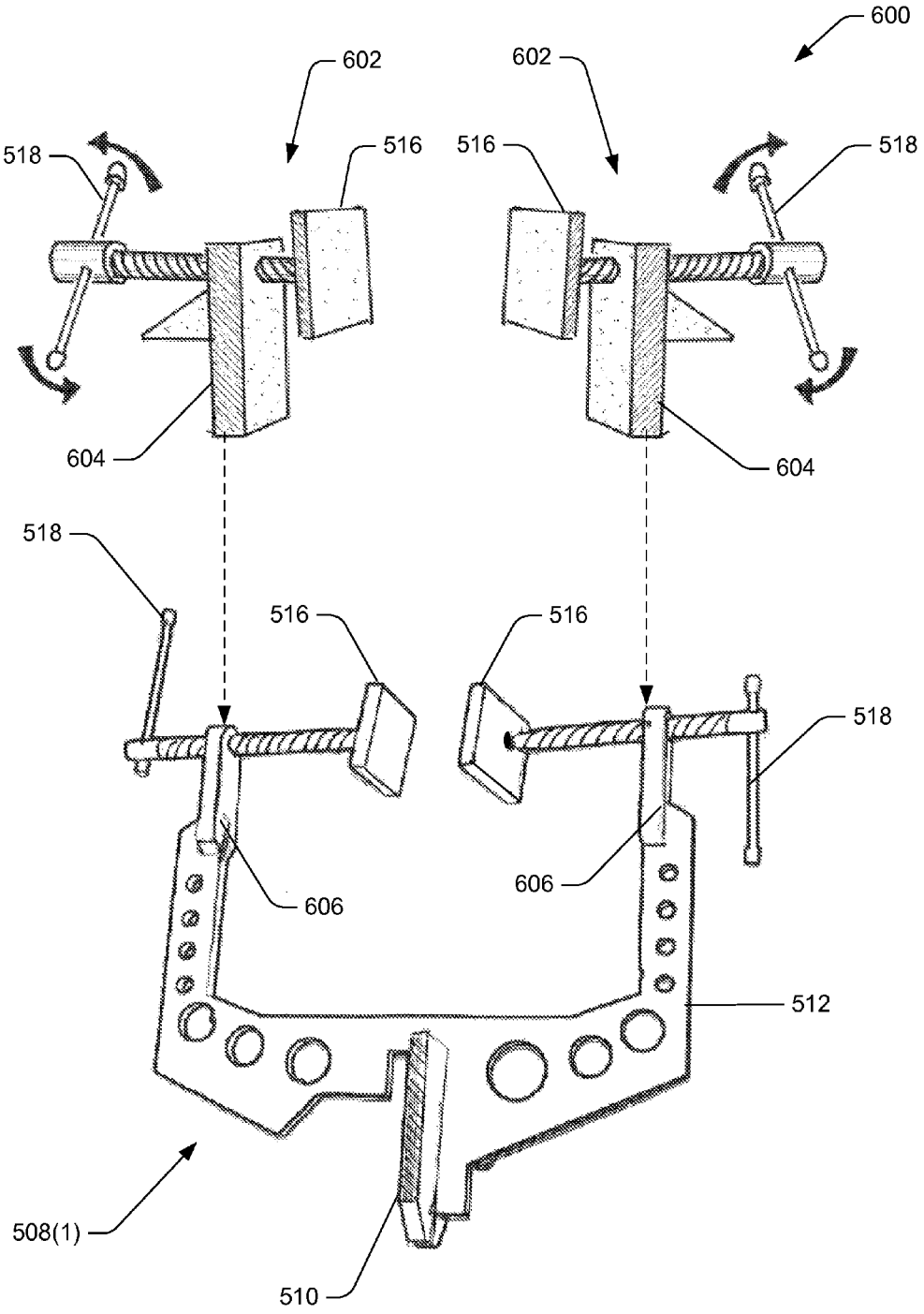
FIG. 6 is an isometric view of the example Lateral axis clamping attachment shown in FIG. 5, with a detachable attachment assembly, in accordance with some examples of the present disclosure.

FIG. 6 is an isometric view of the lateral axis clamping attachment 600 shown in FIG. 5, with a detachable attachment assembly 602. As described above with respect to FIG. 5, the attachment 508(1) can include a fitting 510, a frame 512, two or more contact points 516, and two or more adjusters 518. The attachment 508(1) can also include a support beam, similar to support beam 514.

In various embodiments, the contact points 516 and the adjusters 518 can include an attachment assembly 602. In some embodiments, the attachment assembly 602 can be fixed to the frame 512. In some embodiments, the attachment assembly 602 can be removable and replaceable. In such embodiments, the attachment assembly 602 can be removed from the frame 512 and replaced with different second attachment assembly with contact points 516 and the corresponding adjusters 518 of different shapes (e.g., pin point versus square), sizes (e.g., larger or smaller) and/or configurations (e.g., fixed versus adjustable). For example, if a hobbyist wants to paint an object, the hobbyist may want to decrease the surface area of the contact point. Therefore, the hobbyist can remove an attachment assembly with a square shaped contact point, and replace it with an attachment assembly with a pin point contact shape, such as that illustrated in FIG. 12B.

In various embodiments, the attachment assembly 602 can include an assembly fitting 604, configured to connect to a top end 606 of the frame 512. The assembly fitting 604, similar to fitting 204, may comprise a sleeve, a cutout, one or more magnets, or other attachment mechanism to couple the attachment assembly 602 to the frame 512. In some embodiments, an inside surface of the fitting 604 can include a rubber coating, a plastic coating, or any other material and/or machining process that may increase friction to more firmly secure attachment assembly 602 in place on the stand.

Figure 7:
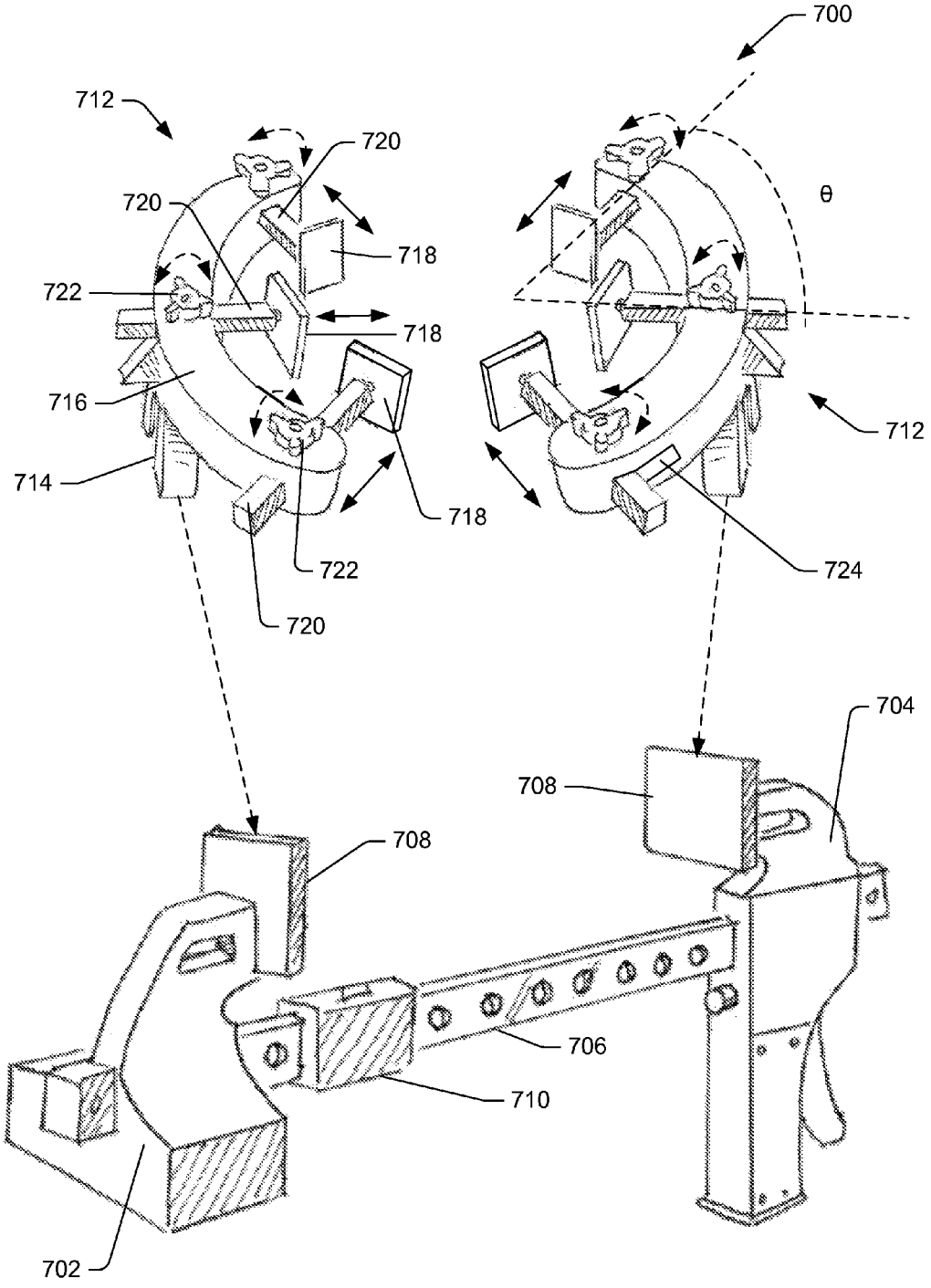
FIG. 7 is an isometric view of an example multi-dimensional cross clamping attachment, in accordance with some examples of the present disclosure.

FIG. 7 is an isometric view of a bar clamp assembly 700 with multi-dimensional cross clamping attachments. As described above with respect to FIGS. 1-5, bar clamp assembly 700 can include a fixed jaw 702, a movable jaw 704, a bar 706, and two or more clamping surfaces 708. Additionally, the bar clamp assembly 700 can include a bar extender 710 to increase a working length and/or depth of the bar 706.

As illustrated in FIG. 7, the bar clamp assembly 700 can include two multi-dimensional clamping attachments 712. The multi-dimensional clamping attachments 712 can include a fitting 714, such as fitting 204. The fitting 714 can include a rubber coating, a plastic coating, or any other material and/or machining process that may increase friction to more firmly secure the attachments to the clamping surface 708. In the illustrative embodiment, the fitting 714 can include a sleeve that couples to and houses clamping surface 708. In other embodiments, the fitting 714 can include a clamp, a snap fit connector, a plug-type connector, or other type connector to more firmly secure the fitting 714 to the clamping surface 708. Additionally or alternatively, the fitting 714 can include one or more magnets to firmly secure the attachments to the clamping surface 708.

In various embodiments, the fitting 714 can be situated on a bottom side of a housing 716. In the illustrative embodiment, the housing 716 includes a semi-circular shape. In other embodiments, the housing 716 can include a V-shape, a U-shape, or other shape which can enable multi-dimensional clamping.

As illustrated in FIG. 7, the housing 716 can house three contact points 718. One or more of the contact points 718 can comprise a square, circle, a rectangle, or other shape capable of securely clamping an object. Additionally or alternatively, one or more of the contact points can comprise a pin point, a rounded point, or any other contact surface capable of securely holding an object in a clamp.

In some embodiments, one or more of the contact points 718 can be fixed in position relative to the housing, determined by the length of arm 720 (e.g., the arm of the contact point is a fixed, non-adjustable distance away from the housing). In such embodiments, the contact points 718 on the housing 716 attached to the movable jaw 704 can move when movable jaw 704 is adjusted along the bar 706 (e.g., along a longitudinal axis of the bar 706). In various embodiments, one or more of the contact points 718 can be adjustable, such as via an adjuster 722. In the illustrative embodiment, each of contact points 718 is adjustable fore and aft along a respective arm 720 (illustrated as the double head arrows). In other embodiments, one or more contact points 718 can be fixed (e.g., non-adjustable), and one or more other contact points 718 can be adjustable.

In the illustrative embodiment, the adjusters 722 can comprise a bolt-type fastener. As illustrated, the bolt-type fastener can be adjusted clockwise or counter-clockwise to tighten or loosen a grip on an arm of the contact point 718. In various embodiments, the adjuster 722 can comprise a screw-type fastener (420 of FIG. 4), a pin-type fastener, a band-type fastener, a snap fastener, or other types of threaded or non-threaded fasteners to secure the arm 720 of the contact point 718 in a desired position.

In various embodiments, the contact point 718 can be connected to the arm 720 in a fixed position. In some embodiments, the contact point 718 can pivot at the connection with the arm 720, such as, for example, in a ball and socket joint. In some embodiments, the contact point 718 can connect to the arm 720 via a hinge joint, a knuckle joint, or other connection mechanism to enable the contact point 718 to move about one or more axes.

In some embodiments, the arms 720 can be slidable within the housing such as via a slot 724 to adjust the angle θ.

Figure 8:
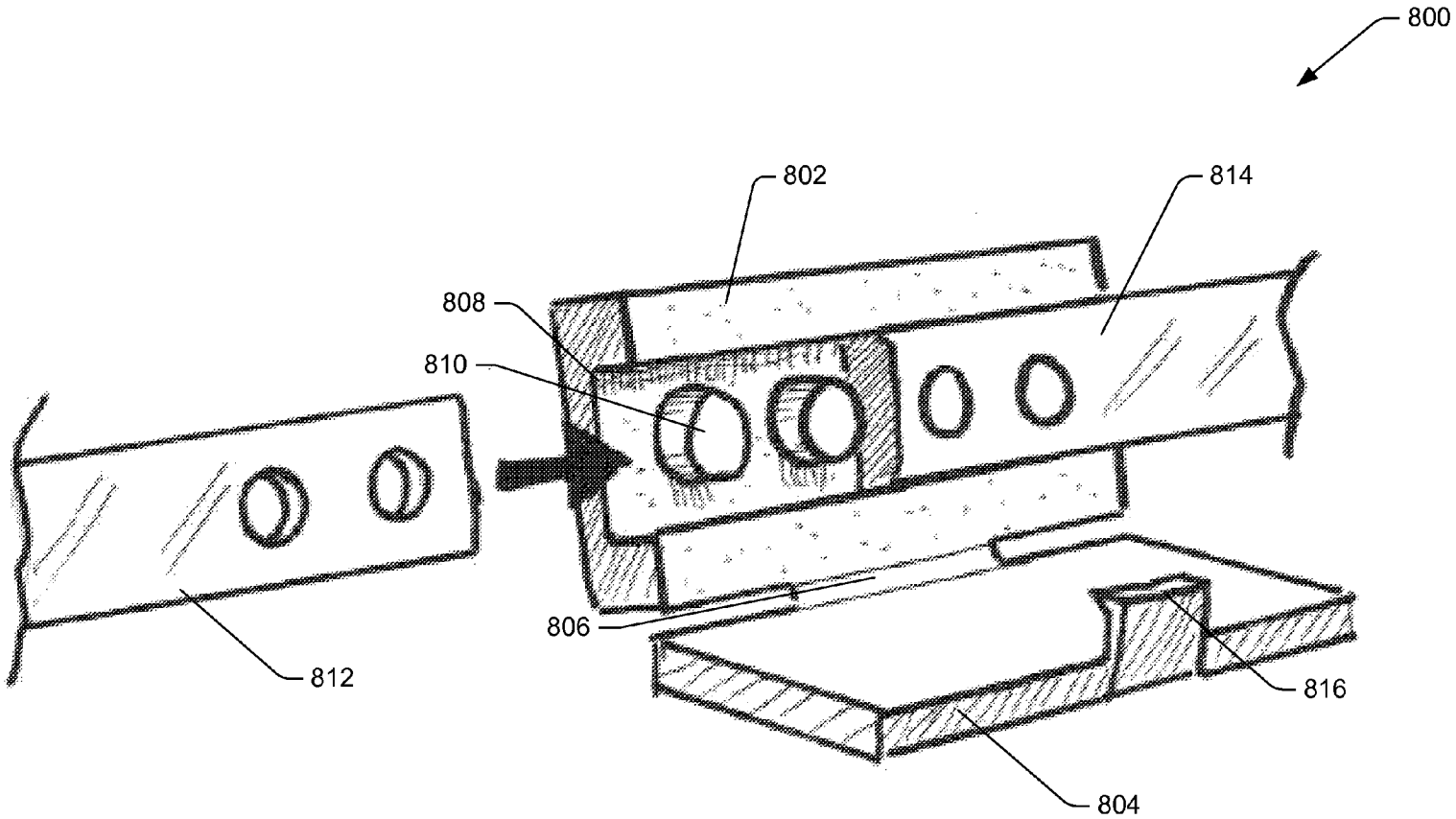
FIG. 8 is a perspective view of an example bar extender that extends the workable length of a bar clamp, in accordance with some examples of the present disclosure.

FIG. 8 is a perspective view of a bar extender 800 capable of increasing the workable length of a bar of a bar clamp assembly. The bar extender 800 can comprise wood, metal (e.g., aluminum, steel, stainless steel, titanium, alloys thereof, etc.), plastic (e.g., high-density polyethylene, acrylic, melamine, polycarbonate, etc.), composite (e.g., fiberglass, carbon fiber, etc.), and combinations thereof, among others.

In various embodiments, the bar extender 800 can include a base section 802, a cover 804, and a hinge 806 situated in between the base section 802 and the cover 804. In some embodiments, the base section 802 can include a cutout 808 and one or more bar holders 810 configured to secure a fixed bar 812, similar to fixed bar 106, and a replaceable bar 814, similar to replaceable bar 116, together. The cutout 808 can be sized to fit the fixed bar 812 and the replaceable bar 814, or it can be larger.

As shown in FIG. 8, the bar holders 810 comprise a raised cylindrical shape, sized to fit circular holes in the fixed bar 812 and the replaceable bar 814. In other embodiments, the bar holders 810 can be sized and shaped to fit holes of other shapes and sizes in the fixed bar 812 and the replaceable bar 814. For example, a fixed bar can comprise triangular holes, while a replaceable bar can comprise circular holes. For another example, certain bar extenders can be built to support longer replaceable bars (e.g., larger, stronger, more durable bar extenders). In such examples, the longer replaceable bars and the compatible bar extenders can include diamond shaped holes and raised bar holders, respectively, at least in part to be easily distinguishable in a tool box from other bar extenders.

In various embodiments, the bar extender 800 can comprise a latch 816. As shown, latch 816 includes a snap fit latch, configured to secure the cover 810 to the base section 802. In other embodiments, the latch 816 can comprise a hook and loop connector, a screw-type connector, a pin connector, a band connector, or other connection mechanisms capable of securing two sides together.

Figure 9:
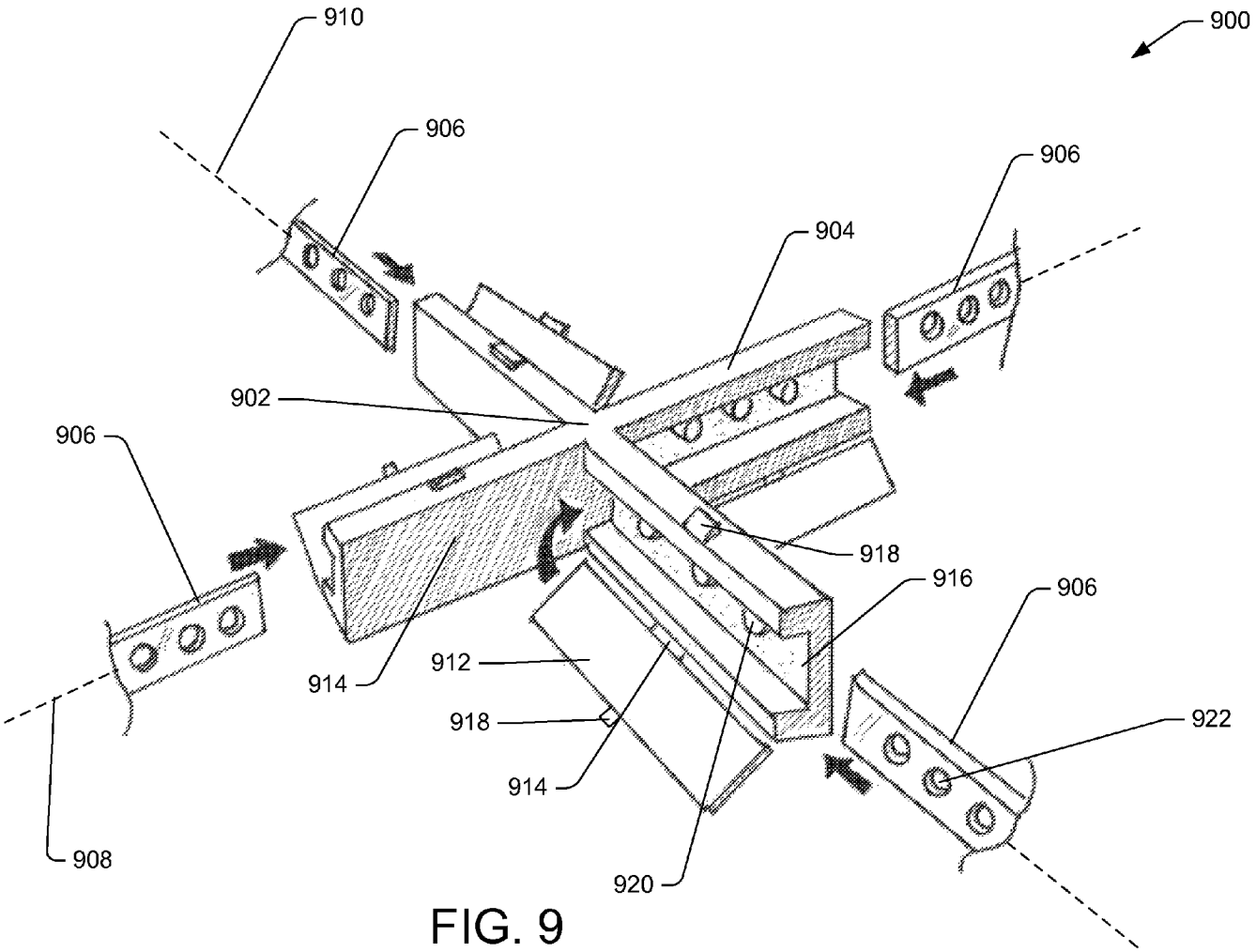
FIG. 9 is a perspective view of an example multi-dimensional bar extender to extend the workable length of the bar clamp and provide clamping capabilities in two dimensions, in accordance with some examples of the present disclosure.

FIG. 9 is a perspective view of a multi-dimensional bar extender 900 that can extend the workable length of the bar clamp and provide clamping capabilities in two dimensions.

The multi-dimensional bar extender 900 can comprise wood, metal, plastic, composite, and combinations thereof, among others. In various embodiments, multiple bar extenders, similar to the bar extender 800, can be configured to couple to each other at a center 902. In such embodiments, the multiple bar extenders can couple together via hook and latch connectors, pin connectors, screw connectors, and the like.

In various embodiments, four bar extenders can be connected together perpendicularly in a cross-shaped configuration. In other embodiments, a fewer or greater number of bar extenders can be coupled together in a multi-dimensional bar extender configuration. For example, three bar extenders can be coupled together, each spaced about 120 degrees from the others. As another example, five bar extenders can be coupled together, each evenly spaced from the adjacent bar extender (e.g., spaced about 72 degrees from one another). As yet another example, six bar extenders can be coupled together, each evenly spaced from the adjacent bar extender (e.g., spaced about 60 degrees from one another).

In the illustrative embodiment, the multi-dimensional bar extender 900 can include a base 904. For clarity, the forward most quadrant of the multi-dimensional bar extender 900 is labeled in detail in FIG. 9. However, each of the four quadrants can include similar features.

In various embodiments, the base 904 can be configured to house four separate bars 906, two along a longitudinal axis 908, and two along a lateral axis 910. In other embodiments, the base 904 can be configured to house a greater or fewer number of bars 906 (e.g., in a triangular pattern, a star pattern, etc.).

As illustrated in FIG. 9, the multi-dimensional bar extender 900 can include covers 912, each cover 912 connected to the base 904 via a respective hinge 916. In various embodiments, the cover 912 can be configured to secure the bar 906 into a cutout 916 of the base 904. The cover 912 and/or the base 904 can include a latch 918 to secure the cover 912 in place over the bar 906 housed in the cutout 916. The latch 918 can comprise a snap connector, a hook and loop connector, a band connector, a screw connector, a push button mechanism, a set screw, a pin, a clip, a detent, or other type of connector to hold the cover 912 in place in the cutout 916.

Additionally, the cutout 912 can comprise one or more bar holders 920, similar to bar holder 810. The bar holders 920 can be sized and shaped to fit one or more holes 922 in the bar 906. As shown, the holes 922 are shown as comprising a circular shape. In other embodiments, the holes 922 can comprise an ovular shape, a square shape, a rectangular shape, a diamond shape, or any other shape.

In various embodiments, a first end of the bar 906 can securely attach to the base 904 via the bar holders 920 and cover 912, and second end of the bar 906 can securely attach to a moveable and/or a fixed jaw of a bar clamp assembly. In such an embodiment, the clamping surfaces on the bar assembly can be configured along the longitudinal axis and the lateral axis to clamp an object along both axes, such as in a square or rectangular configuration.

In embodiments configured to house a greater or fewer number of bars 906, the clamping surfaces attached to the jaw at the second end of the bars 906 can be configured in a triangular configuration, a five-pointed star configuration, or other configuration, based on the number of bars the base 904 is configured to house.

Alternatively, the base 904 can comprise a toothed ratchet system, a tie-down system, or other system to secure the bar 906 to the base 904.

Figure 10:
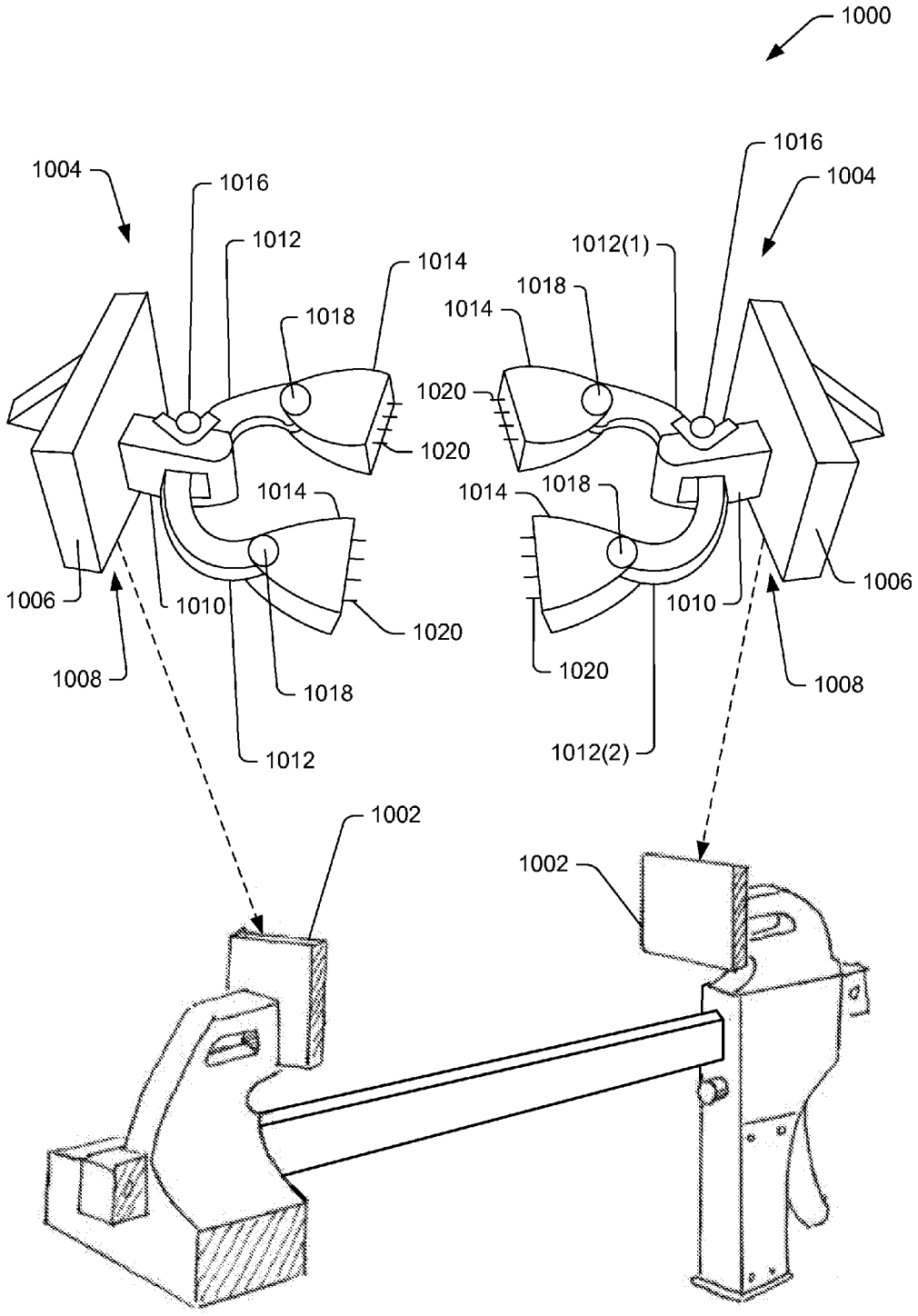
FIG. 10 is an isometric view of an embodiment of a bar clamp assembly with two adjustable attachments configured to secure objects of various shapes and sizes, in accordance with some examples of the present disclosure.

FIG. 10 is an isometric view of an embodiment of a bar clamp assembly 1000 with two adjustable attachments configured to secure objects of various regular and/or irregular shapes and sizes. The bar clamp assembly 1000, similar to the bar clamp assemblies depicted in FIGS. 1-5, can include a fixed jaw, a movable jaw, and a bar. Additionally, the bar clamp assembly 1000 can include clamping surfaces 1002, similar to clamping surfaces 108 shown in FIG. 1.

In various embodiments, the clamping surfaces 1002 can be configured to include one or more removable and replaceable attachments, such as adjustable attachments 1004. In various embodiments, a base section 1006 of the adjustable attachment 1004 can include a fitting 1008, similar to fitting 204, to secure the adjustable attachment 1004 to the clamping surfaces 1002. In some embodiments, the fitting 1008 can include a rubber coating, a plastic coating, or any other material and/or machining process that may increase friction to more firmly secure the adjustable attachments 1004 to the clamping surface 1002. In some embodiments, the fitting 1008 can include a connecting mechanism (e.g., a detent, set screw, push button, etc.) to more firmly secure the base section 1006 of the adjustable attachments 1004 to the clamping surfaces 1002. Additionally or alternatively, the fitting 1008 can include one or more magnets to firmly secure the adjustable attachment 1004 to the clamping surfaces 1002.

In various embodiments, the adjustable attachments 1004 can include an extender 1010, one or more arms 1012, and one or more grippers 1014. As illustrated in FIG. 10, the extender 1010 can be configured to extend perpendicularly (e.g., longitudinally) from the base section 1006. In various embodiments, the extender 1010 can be configured to couple to one or more arms 1012. Additionally, the extender 1010 can include a locking mechanism 1016 to secure the arms 1012 in various positions within the extender 1010. In the illustrative embodiment, the locking mechanism 1016 can comprise a screw-type locking mechanism. Some other embodiments can comprise a pin, a band, or other threaded or non-threaded fastener.

In various embodiments, the arms 1012 can be configured to move along a first plane, parallel with the bar of the bar clamp. In such embodiments, the arms 1012 can be free to move from a zero degree position (e.g., the arms against a backstop of the extender 1010) along the first plane to a position about 160 degrees forward of the zero degree position. In other embodiments, the arms 1012 may be capable of moving a range greater or less than 160 degrees.

In various embodiments, the arms 1012 on opposite sides of the extender, such as the arms 1012(1) and 1012(2), can be connected to one another. The connection between the opposing arms 1012 can be fixed (e.g., allowing no independent movement between opposing arms) or adjustable (e.g., allowing the arms to move independent of one another). In other embodiments, the opposing arms 1012(1) and 1012(2) can be not connected to one another. In such embodiments, the opposing arms 1012(1) and 1012(2) can be locked into position by a single locking mechanism 1016, or each by its own locking mechanism, such as locking mechanism 1016.

The arms 1012 of the adjustable attachments 1004 can couple to the extenders 1010 at a first end, and can couple to the grippers 1014 at a second end, such as, for example, via hinge 1018. In various embodiments, the grippers 1014 can include gripping surfaces 1020.

As illustrated in FIG. 10, the gripping surfaces 1020 can comprise one or more pin-like structures to assist in securing an object between the grippers 1014. In other embodiments, the gripping surfaces 1020 can comprise one or more knobs, studs, dowels, or other structures to secure an object between the grippers. In still yet other embodiments, the gripping surfaces 1020 can comprise a flat surface configured to attach to and hold (e.g., clamp) various objects of regular and/or irregular shape. In various embodiments, the flat surface can include a rubber coating, a plastic coating, or any other material and/or machining process (e.g., knurling) that may increase friction to more firmly secure an object in place between the grippers. For example, the flat surfaces of four grippers can conform around a round object (as depicted in FIG. 11B), such as a ball, and can securely hold the ball against the flat surfaces. In such an example, the arms of the adjustable attachments can be secured at an angle, and the clamping surfaces of the bar clamp assembly can be secured at a distance from one another, to accommodate the size of the ball.

Figure 11A:
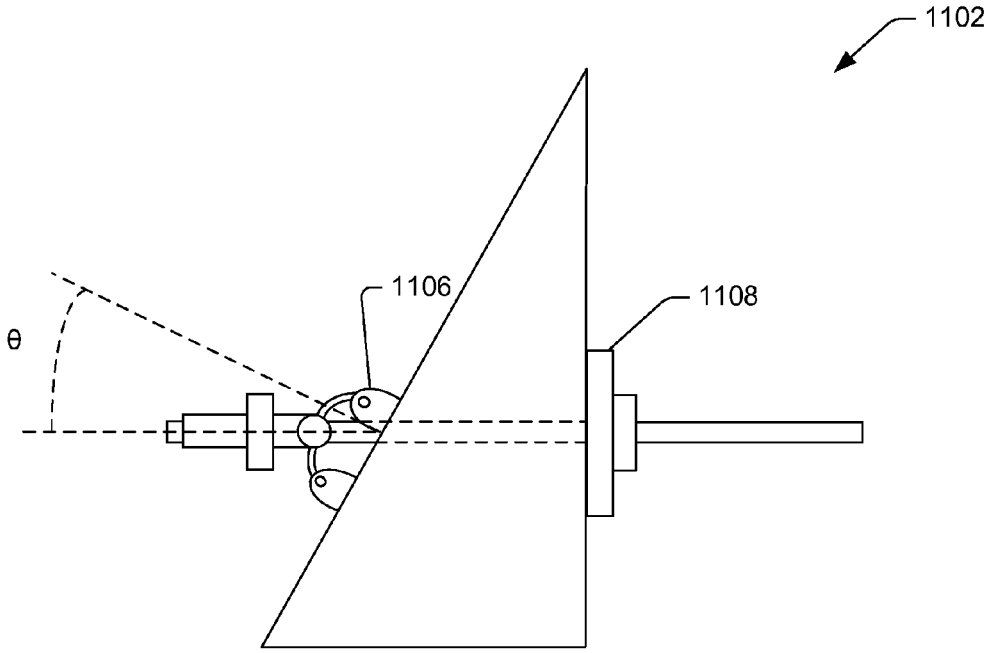
FIGS. 11A and 11B are top views of the example adjustable attachments shown in FIG. 10.
Figure 11B:
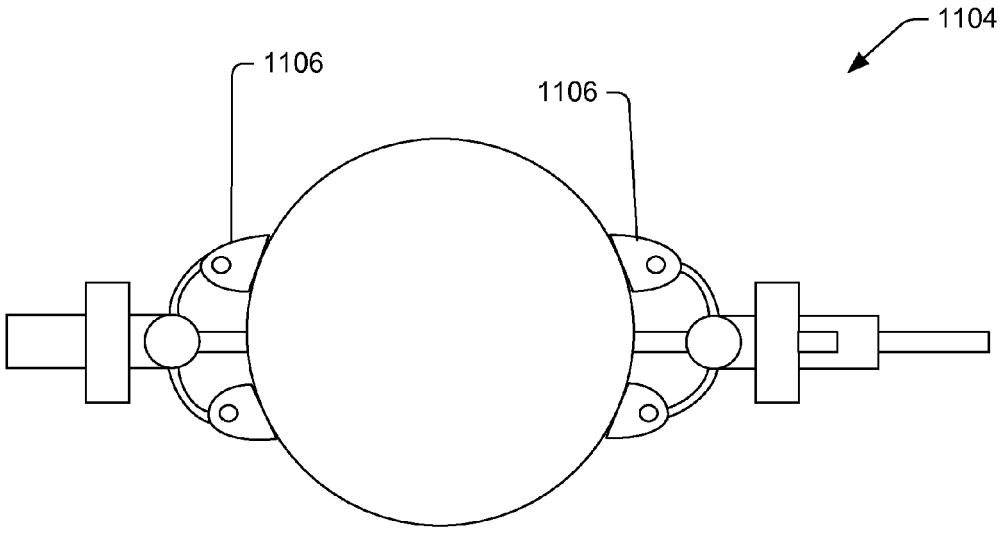

FIGS. 11A and 11B are top views of the adjustable attachments shown in FIG. 10. FIG. 11A depicts a bar clamp assembly 1102 with one adjustable attachment and one fixed attachment securely holding a triangular object. FIG. 11B depicts a bar clamp assembly 1104 with two adjustable bar clamp attachments securely holding a round object.

As depicted in FIG. 11A, one adjustable attachment 1106, such as adjustable attachment 1004, can be securely attached to a bar clamp opposite a flat clamping attachment 1108 and/or a base plate (112 of FIG. 1). The adjustable attachment 1106 can be secured to the clamping surface of the movable jaw, with the flat clamping attachment 1108 secured to the clamping surface of the fixed jaw of the bar clamp assembly, or vice versa. The movable jaw can be adjustable along the bar to secure an object between the adjustable attachment 1106 and the flat clamping attachment 1108. The adjustable attachment 1106 can clamp at an angle θ non-parallel with the bar of the bar clamp assembly.

As illustrated in FIG. 11B, two adjustable attachments 1106 can securely attached to the clamping surfaces of a bar clamp opposite one another. In the illustrative embodiment, the adjustable attachments 1106 include flat gripping surfaces. In other embodiments, the adjustable attachments 1106 can include pin-like structures, knobs, or other structures protruding from a gripper, to securely hold an object between the adjustable attachments 1106.

Figure 12A:
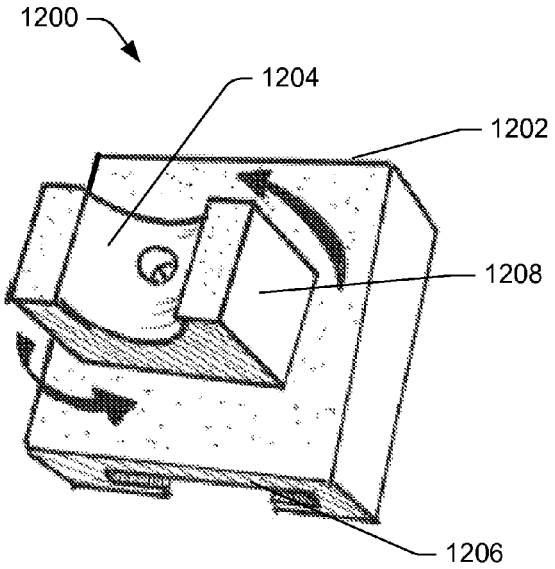
FIGS. 12A, 12B, and 12C are perspective views of various embodiments of bar clamp attachments.
Figure 12B:
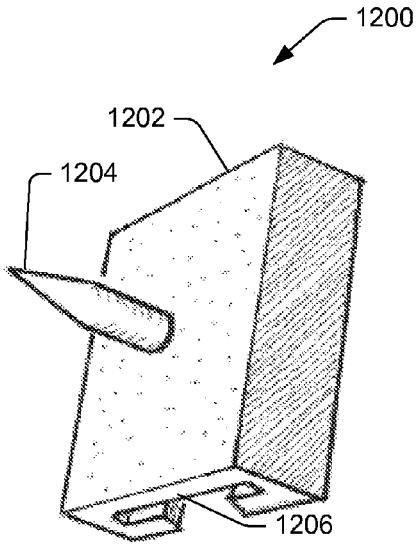
Figure 12C:
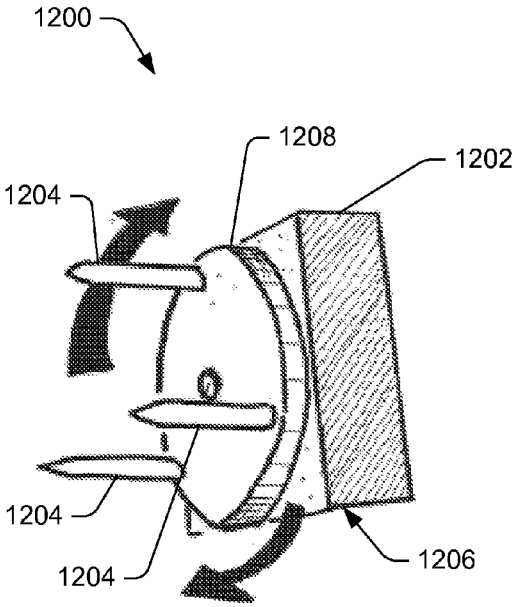

FIGS. 12A, 12B, and 12C are perspective views of various bar clamp attachments. FIG. 12A depicts an embodiment with a rotating, semi-cylindrical contact point. FIG. 12B depicts an embodiment with a single contact point. FIG. 12C depicts an embodiment of an attachment with three contact points.

The bar clamp assemblies, similar to bar clamp assemblies 100, 200, 300, 400, 500, 700, 1000, and 1100, can be configured to accept attachments 1200. In some embodiments, the attachments 1200 can be removable and replaceable. As illustrated in FIGS. 12A-12C, the attachments 1200 can each comprise a base section 1202 and one or more contact points 1204.

In various embodiments, the base section 1202 can comprise a fitting 1206, similar to fitting 204. In some embodiments, the fitting can comprise a rubber coating, a plastic coating, or any other material and/or machining process (e.g., knurling) that may increase friction to more firmly secure the base section 1202 onto a clamping surface, similar to clamping surface 108 of FIG. 1. In other embodiments, the base section 1202 can include a locking mechanism (e.g., a detent, set screw, push button, etc.) to secure the base section to the clamping surface. Additionally or alternatively, the fitting 1206 can include one or more magnets to firmly secure the base section 1202 onto a clamping surface.

In various embodiments, the contact points 1204 can include a semi-cylindrical surface (FIG. 12A), one or more pointed protrusions (FIGS. 12B and 12C), one or more rounded protrusions, a pin-like protrusion, or other surface capable of securely holding objects of various shapes and sizes between two contact points.

In some embodiments, such as FIGS. 12A and 12C, the contact points 1204 can be part of and/or connected to a rotating foundation 1208. In such embodiments, an object secured between opposing contact points can be rotated while secured in the bar clamp assembly. For example, a hobbyist painting a cube can place the cube between two attachments of a bar assembly with rotating foundations, such as the attachment depicted in FIG. 12C. The cube can be secured between the three contact points on opposing attachments. The hobbyist can then rotate the cube to paint four sides of the cube without having to remove the cube from the bar clamp assembly.

In various embodiments, a single contact point 1204, such as the contact point depicted in FIG. 12B, can be rotatable about its own axis. In such an embodiment, the contact point can be configured to spin an object secured between two attachments. For example, a hobbyist painting a round object can place the round object between two attachments with a single, rotatable contact point. The hobbyist can be able to paint the around the entire round object, with the exception of where the contact points hold the object in place.

Figure 13:
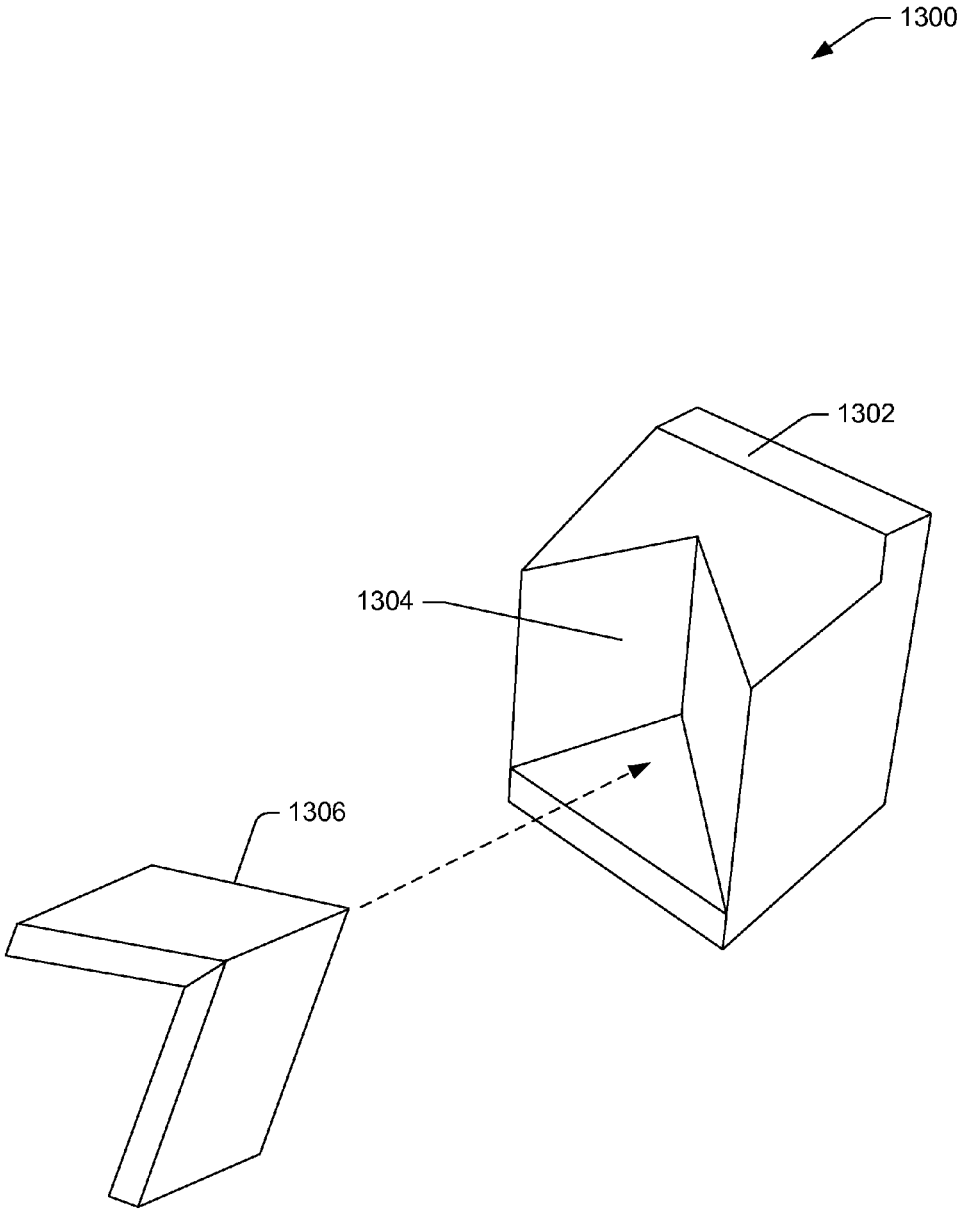
FIG. 13 is a perspective view of an embodiment of a bar clamp attachment with a contact point configured to fit an angled surface, in accordance with some examples of the present disclosure.

FIG. 13 is a perspective view of a bar clamp attachment 1300 with a contact point configured to fit an angled surface. Attachment 1300 can comprise a base section 1302 with a cutout 1304. Additionally, attachment 1300 can comprise a fitting (not illustrated), similar fitting 204 of FIG. 2, to secure the attachment 1300 to a clamping surface of a bar clamp. Additionally or alternatively, the attachment 1300 can comprise one or more magnets to firmly secure the attachment 1300 to the clamping surface of the bar clamp.

In the illustrative embodiment, the cutout 1304 is configured to fit an angled surface 1306. In at least one embodiment, the angled surface 1306 can be configured at a 90 degree angle. In such an embodiment, the attachment 1300 can be capable of securing a corner of a squared-off object. For example, the attachment can securely hold two pieces of corner trim together while glue between the two pieces dries. In such an example, the opposite ends of the two pieces can be secured by one or more other attachments on a bar clamp assembly and/or with a multi-dimensional bar extender.

In some embodiments, the angled surface 1306 can be configured for angles greater or less than 90 degrees, such as, for example, for corner trim configured at an acute or an obtuse angle. Thus, the bar clamp attachment 1300 can provide a system to clamp irregular objects that are typically ill-suited for clamping.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A device for increasing the capacity of a bar clamp comprising:

a first height extender detachably coupled, via a first fitting, to a first clamping surface of a first fixed jaw of a bar clamp, wherein the first fitting comprises a first sleeve with a first coating to increase friction between the first height extender and the first clamping surface;

a second height extender detachably coupled, via a second fitting, to a second clamping surface of a movable jaw of the bar clamp, wherein the second fitting comprises a second sleeve with a second coating to increase friction between the second height extender and the second clamping surface;

a first attachment detachably coupled to a top end of the first height extender, the first attachment comprising:

a first base section configured to connect to the first height extender; and a third clamping surface attached to the first base section; and a second attachment detachably coupled to a top end of the second height extender, the second attachment comprising:

a second base section configured to connect to the second height extender; and a fourth clamping surface attached to the second base section, wherein the fourth clamping surface is attached to the second base section via a horizontal extender, the horizontal extender configured to adjust a distance between the fourth clamping surface and the second base section.

2. The device as claim 1 recites, further comprising a depth extender disposed between the third clamping surface and the first base section to increase the clamping depth of the bar clamp.

3. The device as claim 1 recites, further comprising:

a replaceable bar to extend a bar of the bar clamp; and a bar extender, the bar extender configured to couple a second end of the bar to a first end of the replaceable bar;

wherein the movable jaw is movable along the replaceable bar from the first end of the replaceable bar proximate the bar extender to a second end of the replaceable bar distal the bar extender.

4. The device as claim 1 recites, further comprising:

a first stand detachably coupled to the fixed jaw;

a second stand detachably coupled to the movable jaw, wherein the first stand and the second stand each comprise:

a vertical support connected at a first end to a respective jaw;

a horizontal support connected to a second end of the vertical support;

at least one extender adjustable along a horizontal plane from a first position proximate to the horizontal support to a second position;

wherein an angled position increases the footprint of the stand.

5. The device as claim 1 recites, wherein the third clamping surface and the fourth clamping surface comprise one or more of:

a stationary semi-circular surface;

a rotating semi-circular surface;

one or more stationary pointed dowels;

one or more rotating pointed dowels;

one or more stationary rounded dowels;

one or more rotating rounded dowels;

a cutout configured to fit an angled surface;

a rubber coating;

a plastic coating;

a flat surface;

a rounded surface; and a knurled surface.

6. The device as claim 4 recites, further comprising:

a securing mechanism configured to secure the at least one extender in place at least in the angled position.

* * * * *